US007392742B2

(12) United States Patent
Schaschek et al.

(10) Patent No.: US 7,392,742 B2
(45) Date of Patent: Jul. 1, 2008

(54) DEVICES FOR SUPPORTING AND ADJUSTING A FORM CYLINDER IN A PRINTING GROUP OF A ROTARY PRINTING PRESS

(75) Inventors: Karl Erich Albert Schaschek, Thüngen (DE); Georg Schneider, Würzburg (DE); Martin Heinz Schoeps, Güntersleben (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 418 days.

(21) Appl. No.: 10/517,607

(22) PCT Filed: Jan. 31, 2003

(86) PCT No.: PCT/DE03/00270

§ 371 (c)(1),
(2), (4) Date: Dec. 22, 2004

(87) PCT Pub. No.: WO04/000557

PCT Pub. Date: Dec. 31, 2003

(65) Prior Publication Data

US 2005/0223921 A1 Oct. 13, 2005

(30) Foreign Application Priority Data

Jun. 25, 2002 (DE) ..... 102 28 242

(51) Int. Cl.
*B41F 13/20* (2006.01)
*B41F 13/21* (2006.01)

(52) U.S. Cl. ..... 101/218; 101/247; 101/216

(58) Field of Classification Search ..... 101/216–218, 101/247, 487

See application file for complete search history.

(56) References Cited

U.S. PATENT DOCUMENTS

| | | | | |
|---|---|---|---|---|
| 4,391,191 | A | 7/1983 | Bolza-Schunemann | |
| 4,426,897 | A * | 1/1984 | Littleton | 83/37 |
| 5,487,338 | A | 1/1996 | Lewis et al. | |
| 5,595,115 | A | 1/1997 | Rau et al. | |
| 5,784,957 | A | 7/1998 | Rau et al. | |
| 6,085,650 | A | 7/2000 | Petersen | |
| 6,227,111 | B1 | 5/2001 | Dawley et al. | |
| 6,314,882 | B1 | 11/2001 | Petersen | |

(Continued)

FOREIGN PATENT DOCUMENTS

| | | |
|---|---|---|
| DE | 113 187 | 5/1975 |

(Continued)

*Primary Examiner*—Leslie J Evanisko
(74) *Attorney, Agent, or Firm*—Jones, Tullar & Cooper, PC

(57) ABSTRACT

A forme cylinder is supported and adjusted in a printing group of a rotary printing press, which group includes a transfer cylinder and a counter-pressure cylinder, which two cylinders include interacting support elements. The forme cylinder does not include a support element which interacts with the transfer cylinder. The forme cylinder has a shaft distance that can be adjusted during printing to adjust a contact pressure between the forme cylinder and the transfer cylinder. The forme cylinder may be covered with a waterless printing forme. The contact pressure between the forme cylinder and the transfer cylinder can be adjusted to a property, such as the compressibility, of the waterless printing forme.

15 Claims, 1 Drawing Sheet

U.S. PATENT DOCUMENTS

| | | | | |
|---|---|---|---|---|
| 6,502,508 | B1 | 1/2003 | Schaede et al. | |
| 6,539,857 | B1 * | 4/2003 | Weschenfelder | 101/137 |
| 6,712,000 | B1 * | 3/2004 | Holm et al. | 101/216 |
| 6,810,812 | B2 * | 11/2004 | Fischer | 101/485 |
| 6,827,011 | B2 | 12/2004 | Liebler et al. | |

FOREIGN PATENT DOCUMENTS

| | | | |
|---|---|---|---|
| DE | 28 05 153 | A1 | 7/1979 |
| DE | 29 26 570 | C2 | 9/1987 |
| DE | 41 42 791 | A1 | 6/1993 |
| DE | 195 01 243 | A11 | 7/1996 |
| DE | 198 05 898 | A1 | 11/1999 |
| DE | 199 44 936 | A1 | 4/2000 |
| EP | 0 487 836 | A1 | 6/1992 |
| EP | 0 652 104 | A1 | 5/1995 |
| GB | 2 013 569 | A | 8/1979 |
| WO | WO 00/41887 | | 7/2000 |
| WO | WO 02/24453 | A1 | 3/2002 |

* cited by examiner

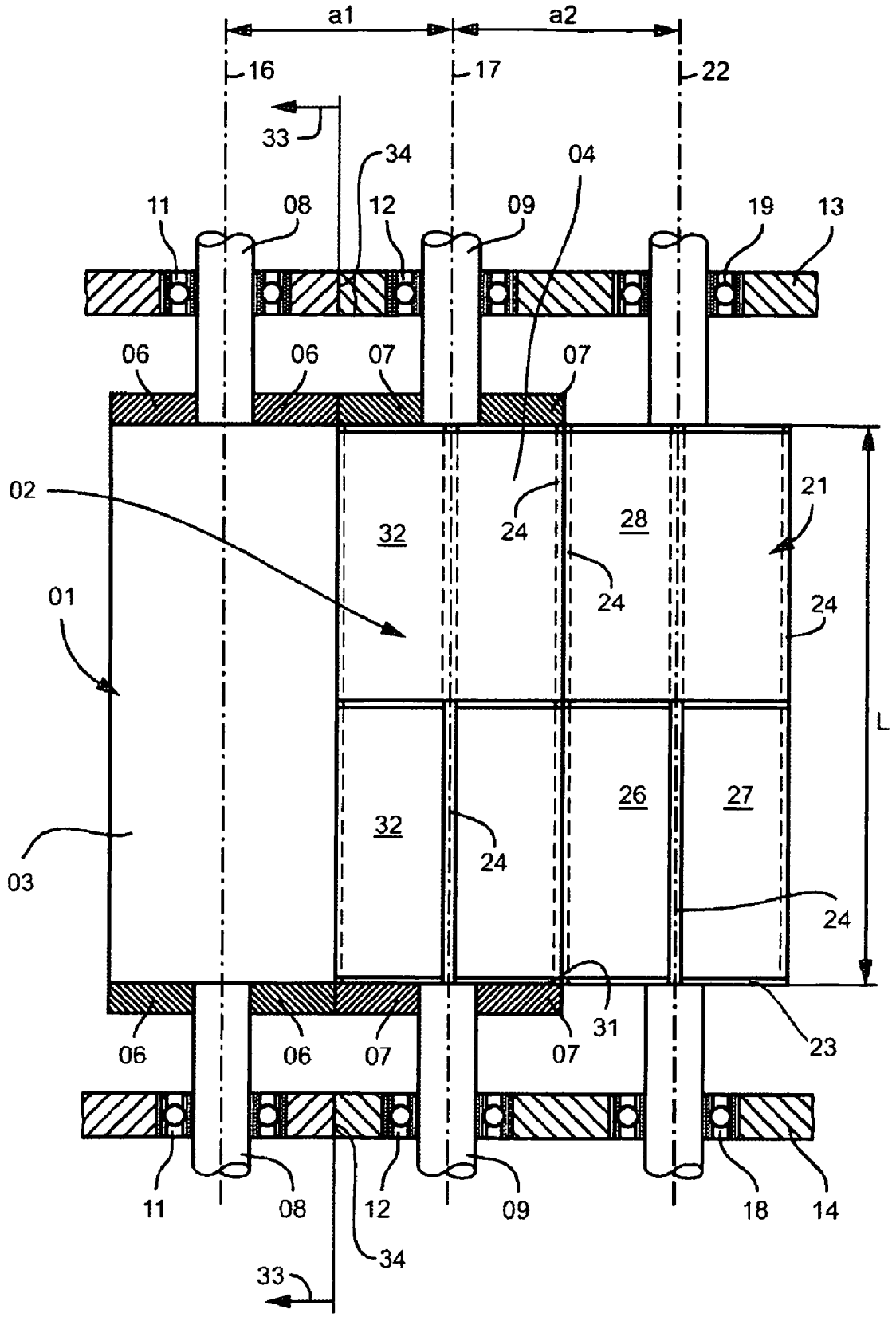
a1
a2
16
17
22
33
34
04
11
08
12
09
19
13
06
06
07
07
02
32
24
28
21
01
24
24
L
26
27
32
24
03
24
31
06
06
07
07
23
11
08
12
09
18
14
34
33

DEVICES FOR SUPPORTING AND ADJUSTING A FORM CYLINDER IN A PRINTING GROUP OF A ROTARY PRINTING PRESS

CROSS-REFERENCE TO RELATED APPLICATIONS

This U.S. utility patent application is the U.S. national phase, under 35 USC 371, of PCT/DE2003/000270, filed Jan. 31, 2003; published as WO 2004/000557 A1 on Dec. 31, 2003 and claiming priority to DE 102 28 242 filed Jun. 25, 2002, the disclosures of which are expressly incorporated herein by reference.

FIELD OF THE INVENTION

The present invention is directed to devices in a printing group of a rotary printing press, having a forme cylinder, a transfer cylinder and a counter-pressure cylinder. A support element cooperating with the transfer cylinder is not provided at the forme cylinder. The forme cylinder can have a waterless printing forme.

BACKGROUND OF THE INVENTION

A device in a printing group of a rotary printing press, having a forme cylinder, a transfer cylinder and a counter-pressure cylinder is known from WO 00/41887 A1. The transfer cylinder and the counter-pressure cylinder have cooperating support elements. To compensate for unwinding differences between the cylinders with the support elements, and/or to prevent unacceptable wear of the support elements, it has been optionally provided that a normal force, i.e. a contact force, between the support elements can be adjusted, and that a shaft distance between the transfer cylinder and the counter-pressure cylinder can be changed. One of the two cylinders with support elements is seated in an eccentric bushing.

Cylinders of a rotary printing press and having so-called bearer rings, are known from DE 29 26 570 C2 and from DE 195 01 243 A1. The bearer rings of adjoining cylinders are supported on each other. Bearer rings are support elements, configured as barrel rings, and arranged on the journals of cylinders and supporting the two ends of the cylinder in order to reduce undesired cylinder vibrations and in this way to make possible clean printing in spite of groove beat. The bearer rings are of such dimensions that the bearer rings arranged on cooperating adjoining cylinders roll off on each other. Thus a defined shaft distance between two printing group cylinders of a rotary printing group is also achieved by the use of such a bearer ring arrangement. Because of their support of the cylinders, which bearer ring support exists in addition to the seating of the cylinders, the bearer rings cause dampening of cylinder vibrations, which are excited, in the course of the rotation of the cylinders, by grooves, which grooves have necessarily been cut into, or formed in the cylinders for holding dressings.

As can be seen in DE 28 02 153 A1, the bearer rings are pushed together under considerable pressure. This is done in order to prevent the bearer rings, which run off on each other, from lifting or sliding off during the printing process.

An arrangement for setting the contact pressure between cylinders of a rotary printing press is known from DD-PS 113 187. The arrangement for plate cylinder adjustment is constructed analogously to that for printing cylinder adjustment.

Document DE 41 42 791 A1 relates to a device for setting the printing pressure, as well as for setting the print-on and print-off setting of printing presses, which can be selectively operated with bearer ring or without bearer ring contact. The device makes possible a common, synchronous adjustment of several cylinders with respect to each other, in a single adjustment process while printing with the bearer rings in contact, as well as with the bearer rings out of contact. In particular, with a change of the printing pressure between the rubber blanket cylinder and the printing cylinder, the plate cylinder is moved to follow the rubber blanket cylinder in such a way that, independently of the printing gap between the rubber blanket and the printing cylinders, the shaft distance between the plate cylinder and the rubber blanket cylinder always remains the same.

SUMMARY OF THE INVENTION

The object of the present invention is directed to providing a device with a forme cylinder, a transfer cylinder and a counter-pressure cylinder in a printing group of a rotary printing press.

In accordance with the present invention, this object is attained by the provision of a printing group of a rotary printing press and having a forme cylinder, a transfer cylinder and a counter-pressure cylinder. The transfer cylinder and the counter-pressure cylinders have cooperating support elements. A support element cooperating with the transfer cylinder is not provided at the forme cylinder. A shaft distance between the forme cylinder and the transfer cylinder can be adjusted to set a contact pressure. The forme cylinder may carry a waterless printing forme. The contact pressure between the forme cylinder and the blanket cylinder can be matched to a property of the printing forme.

The advantages to be gained by the present invention reside, in particular, in that, in the course of setting and adjustment of the contact pressure required between the forme cylinder and the transfer cylinder, support elements between these cylinders, which support elements correspond with each other and which limit the adjusting path, need not be taken into consideration. Since support elements customary in printing groups, such support elements being, for example, in the form of bearer rings, are mostly put into contact under prestress, a considerably reduced force is required for setting and adjustment if these support elements are omitted at the forme cylinder. Thus, appropriate drive mechanisms and force transfer devices can be configured with lower output, which leads to savings of cost and energy. Setting the contact pressure between the form cylinder and the transfer cylinder is therefore made easier if no support elements exist at the forme cylinder. On the other hand, the support elements remain in those locations where they are needed, for example in such locations as between the transfer cylinder and the counter-pressure cylinder. Support elements are required at this location, because clamping grooves formed in the transfer cylinder are the main cause of the so-called groove beat. The transfer cylinder should therefore remain supported in order to increase its quiet running. The configuration of a printing group in accordance with the present invention has particular advantages in cases where the forme cylinder is covered by a printing form that is coated with silicon. The durability of the printing forme applied to a forme cylinder is increased because of the improved adaptability of the contact pressure between the forme cylinder and the transfer cylinder, which increased durability applies, in particular, to waterless offset printing. Because of the provided capability of adjustment of the contact pressure, the print quality which can be achieved by the use of the printing forme can be, in addition, improved even during the ongoing printing process. Moreover, lubrication and cleaning of the bearer rings arranged between the forme cylinder and the transfer cylinder, which would otherwise be required, is not required because those bearer rings have been omitted.

BRIEF DESCRIPTION OF THE DRAWING

The sole drawing FIGURE is a simplified representation of a printing group with a forme cylinder, a transfer cylinder and a counter-pressure cylinder in accordance with the present invention.

DESCRIPTION OF THE PREFERRED EMBODIMENT

A planographic printing process, in particular a printing group operating by waterless offset printing, is depicted in the sole drawing FIGURE as an example of a printing group with which the present invention may be used. A print position of a rotary printing press, that is arranged in the printing group, is formed by a cylinder 01 which, for example, is embodied as a counter-pressure cylinder 01, and another cylinder 02 which, for example, is embodied as a transfer cylinder 02. A material to be imprinted, for example a paper web which is not specifically represented, is conducted between these two cylinders 01, 02. These cylinders 01, 02 are provided, at both ends of their respective barrels 03, 04, with support elements 06, 07, respectively which may be, for example, bearer rings 06, 07, wherein each cylinder barrel 03, 04 has a length L. The bearer rings 06,07 of the adjoining cylinders 01, 02, respectively, roll off in pairs against each other. The cylinders 01, 02 are provided with journals 08, 09, respectively, which journals are seated by bearings 11, 12 in lateral frames 13, 14. A first shaft distance a1, for example of a1=400 mm, between the rotary shafts 16, 17 of the two cylinders 01, 02 and extending beyond the shaft journals 08, 09, respectively can be changed because, for example, at least one cylinder 01 or 02 of the cooperating pair of cylinders 01, 02 is arranged to be pivotable or to be displaceable. At least one forme cylinder 21, that is provided with a rotary shaft 22, which is also seated in the lateral frames 13, 14, preferably in eccentric bushings 18, 19, is assigned to the transfer cylinder 02. The rotary shaft 22 of the forme cylinder 21 and the rotary shaft 17 of the transfer cylinder 02 have a second shaft distance a2 with respect to each other, which second shaft distance a2 can be set and, if required, can also be adjusted as needed.

On its surface area 23, the forme cylinder 21 can have, for example, four printing formes 26 to 29. The printing formes 26 to 29 can be configured as printing plates, for example, and in particular as waterless planographic printing formes, which printing formes are placed onto the forme cylinder surface area 23 and are maintained in grooves 24 that have been cut into the forme cylinder 21. The covering of the forme cylinder 21 can, for example, be such that respectively two printing formes 26 and 27, or 28 and 29, with the latter printing forme 29 being not specifically represented in the sole drawing, since in this representation it is located on the back of the forme cylinder 21, are arranged next to each other in the circumferential direction. The side-by-side arranged printing formes 26 and 27, or 28 and 29, are each offset with respect to the other by 90°. On its surface area 31, the transfer cylinder 02 has one or several printing blankets 32, which are also preferably maintained in one or in several grooves 24 which have been cut into the surface area 31 and which are, if required, arranged offset with respect to each other in the circumference of the transfer cylinder 02.

The described printing location can also be arranged, for example, in a four-cylinder printing group, in which the counter-pressure cylinder is also configured as a transfer cylinder. In such an arrangement, a further, non-represented form cylinder is assigned to this transfer cylinder in such a way that these two cylinders run off on each other. This printing group can also be expanded into an eight-part tower. However, it is also possible to employ the previously described printing locations in connection with a counter-pressure cylinder in a five-cylinder printing group, for example, in a ten-cylinder printing group consisting of two five-cylinder printing groups, or in a nine-cylinder printing group.

The printing group being described here is typically operated in a planographic printing process and preferably uses a printing forme that is suitable for waterless offset printing, commonly referred to as "dry offset printing". The expression "waterless offset printing" identifies a printing group operating without a dampening system. No supply of a dampening agent, for forming the non-printing areas, is required in addition to the supply of printing ink. With waterless offset printing, the application of a film of moisture to the printing forme is omitted, which film of moisture, in so-called "wet offset printing", prevents the non-printing portions on the printing forme from picking up printing ink. In waterless offset printing this prevention of ink pick up in the non-printing areas of the printing forme is achieved by the use of special printing inks and by a special structure of the surface of the printing forme.

A printing forme, that is suitable for use in waterless offset printing, preferably has a support layer, or a substrate, which can be made of aluminum and which can have a suitable support layer or substrate thickness for achieving the desired mechanical properties. An ink-accepting layer is applied to this support layer or substrate, as well as an ink-rejecting layer that is applied above the ink accepting layer. The ink-accepting layer can be embodied as a polyethylene film. Its thickness can lie in the range between 5 and 50 μm, and it preferably is approximately 20 μm. The ink-rejecting layer can consist, for example, of silicon. Its thickness is suitably selected. It can lie within the range of a few μm, for example with a thickness of approximately 2 μm. In waterless offset printing, the ink-rejecting silicon layer takes over the role of the hydrophilic layer used in wet offset printing, which hydrophilic layer can be covered by a dampening agent and prevents that area of the printing forme from picking up ink. An adhesive or a base layer can lie between the substrate and the ink-accepting layer in the form of, for example, a titanium oxide layer. In U.S. Pat. No. 5,487,338, a printing form that is suitable for waterless offset printing and which is a product of the Presstek company, and sold under the name PearlDry is described by way of example.

In waterless offset printing, a problem sometimes occurs because, due to the lack of dampening agent, an increased temperature can possibly occur in the printing group, which increased temperature is too high for the printing process, or for the printing inks used. It has accordingly been proposed, in EP 652 104 A1, to control the temperature of the surface of cylinders used in a printing group for waterless offset printing. Moreover, in a printing group operating without a dampening agent, soiling resulting from dust and from particles rubbed-off the material to be imprinted, as well as from ink residue, can be very problematic, because cleaning of the cylinders, which would otherwise be performed by the dampening agent, no longer exists. Accordingly, with the use of too strong a contact pressure between the forme cylinder and the transfer cylinder, wherein the force forming the contact pressure can be approximately 10 N per cm of barrel length, the danger of grinding exists. For these reasons, and in view of the rather reduced mechanical strength and the reduced temperature resistance of the printing formes for waterless offset printing, in comparison with conventional printing formes, which are typically essentially completely made of an aluminum alloy, it is necessary to configure the printing group used in waterless printing in such a way that the contact pressure between the forme cylinder and the transfer cylinder can be changed in accordance with the properties of a waterless printing form and thus can be adapted as needed. In this case, the adaptability takes place, in particular, with respect to the property of pressure stressing of the printing forme. It can also be related to the temperature stressing or to surface hardness, and in particular to scratch resistance, and therefore to the wear resistance of the printing forme. Furthermore, the frictional heat, which is caused by the contact pressure, has an effect on the behavior of the printing ink used in the printing process, in particular affecting the ink's flowability and its adhesion to the printing forme, and finally on the material to be imprinted, and therefore the print quality, so that the setting and adjustment of the contact pressure can also take place by taking these process parameters into consideration. Furthermore, with some applications it can also be useful to control the temperature of the form cylinder 21 in addition to the described steps. A temperature-control medium can flow through at least one cooling conduit, and preferably can flow through several such cooling conduits, which are arranged in the forme cylinder 21. At least one such cooling conduit is preferably arranged closely underneath the surface area 23 of the forme cylinder 21.

The contact pressure between the forme cylinder 21 and the transfer cylinder 02 can be set or changed by variance of the second shaft distance a2 between the forme cylinder 21 and the transfer cylinder 02. The shaft distance a2 has different values at different contact pressures. During the printing process, the forme cylinder 21 can be in different positions in relation to the transfer cylinder 02. This variance or adaptation can be easily performed if the forme cylinder 21 does not have a support element, such as a bearer ring 06, 07, cooperating with the transfer cylinder 02. Such a support element 06, 07, if it were arranged on the forme cylinder 21, would limit the adjustment possibilities of the forme cylinder 21, or would at least make them considerably more difficult. At the same time support elements 06, 07, such as, for example, support elements in the form of bearer rings 06, 07, have been arranged between the transfer cylinder 02 and the assigned counter-pressure cylinder 01, in particular for improving the quiet running of the transfer cylinder 02. A contact pressure between the forme cylinder 21 and the transfer cylinder 02 can also be set, preferably during an ongoing printing process. This can be done, in particular, by remote control from a command console which is assigned to the printing press, by the step of a change of their shaft distance a2, and can be adjusted with regard to a contact pressure which is optimal with respect to the durability of the printing formes 26 to 29 and to the print quality desired.

It is advantageous that the rotary shaft 22 of the forme cylinder 21 is in operative connection with at least one eccentric bushing 18, 19, with a lever arrangement, or with a linear drive mechanism, both of which are not specifically depicted and by use of which the forme cylinder 21 can be placed against the transfer cylinder 02 in a desired or required way. An eccentric cylinder bearing, without bushings, can be used in place of the eccentric bushing 18, 19. In a printing group configured in accordance with the present invention, the support element 07 of the transfer cylinder 02 and the support element 06 of the counter-pressure cylinder 01 are preferably still arranged so that they roll off on each other. It is of advantage that the transfer cylinder 02 and the counter-pressure cylinder 01 can be distanced from each other, for example by pivoting or by traveling a displacement path. Thus, as indicated in the sole drawing FIGURE by the directional arrows 33 and by the seam 34 in the lateral frames 13, 14, the portion of the lateral frames 13, 14 in which the counter-pressure cylinder 01 is seated can be configured to be movable with respect to the remaining parts thereof, for example for conducting a web of a material to be imprinted, such as, for example, a paper web, between the counter-pressure cylinder 01 and the transfer cylinder 02. In this way, the setting of the first shaft distance a1, and therefore the setting of the contact pressure between the counter-pressure cylinder 01 and the transfer cylinder 02, is independent of the setting of the shaft distance a2 and therefore is also independent of the corresponding contact pressure between the transfer cylinder 02 and the forme cylinder 21. As previously mentioned, the counter-pressure cylinder 21 can also be configured as a transfer cylinder and can form a further printing location together with a further forme cylinder.

While a preferred embodiment of devices for supporting and adjusting a forme cylinder in a printing group of a rotary printing press, in accordance with the present invention, has been set forth fully and completely hereinabove, it will be apparent to one of skill in the art that changes in, for example the overall sizes of the printing cylinders, the drives for the cylinders, and the like could be made without departing from the true spirit and scope of the present invention which is accordingly to be limited only by the amended claims.

What is claimed is:

1. A printing group of a rotary printing press comprising:

a forme cylinder;

a transfer cylinder in contact with said forme cylinder;

a first support element on said transfer cylinder;

a counter-pressure cylinder in contact with said transfer cylinder;

a second support element on said counter-pressure cylinder and engagable with said first support element, said first and second support elements on said transfer cylinder and on said counter-pressure cylinder cooperating with each other to set a first contact pressure between said transfer cylinder and said counter-pressure cylinder;

a shaft distance between said forme cylinder and said transfer cylinder; and means for adjusting said shaft distance during an ongoing printing operation of said printing group to set a second contact pressure between said forme cylinder and said transfer cylinder.

2. The printing group of claim 1 wherein a position of said forme cylinder with respect to said transfer cylinder can be set.

3. The printing group of claim 1 wherein said shaft distance has different values to vary said second contact pressure.

4. The printing group of claim 1 further including at least one printing forme coated with silicon on said forme cylinder.

5. The printing group of claim 1 further including at least one waterless printing forme on said forme cylinder.

6. The printing group of claim 1 where said forme cylinder has a surface and further including a printing plate securable to said forme cylinder surface.

7. The printing group of claim 1 wherein said means for adjusting said shaft distance is an eccentric bearing.

8. The printing group of claim 7 wherein said eccentric bearing is an eccentric bushing.

9. The printing group of claim 1 wherein said support elements roll off against each other.

10. The printing group of claim 1 further including a second forme cylinder and wherein said counter-pressure cylinder is a second transfer cylinder cooperating with said second forme cylinder.

11. The printing group of claim 1 further including a displacement path defining a path of movement of said transfer cylinder and said counter-pressure cylinder.

12. The printing group of claim 1 wherein said printing group is a component of a four cylinder printing group.

13. The printing group of claim 1 wherein said forme cylinder is temperature regulated.

14. The printing group of claim 13 further including at least one cooling conduit in said forme cylinder and means flowing a temperature regulating medium through said at least one cooling conduit.

15. The printing group of claim 14 wherein said at least one cooling conduit is arranged close to a surface area of said forme cylinder.

* * * * *